US007038153B2

(12) United States Patent
Zamecnik

(10) Patent No.: US 7,038,153 B2
(45) Date of Patent: May 2, 2006

(54) LIGHT SWITCH EXTENSION

(75) Inventor: James Zamecnik, Joliet, IL (US)

(73) Assignee: Z-Enterprises, Joliet, IL (US)

( * ) Notice: Subject to any disclaimer, the term of this patent is extended or adjusted under 35 U.S.C. 154(b) by 0 days.

(21) Appl. No.: 11/046,284

(22) Filed: Jan. 28, 2005

(65) Prior Publication Data

US 2005/0230234 A1 Oct. 20, 2005

Related U.S. Application Data

(60) Provisional application No. 60/558,324, filed on Mar. 31, 2004.

(51) Int. Cl.
*H01H 3/20* (2006.01)

(52) U.S. Cl. ..... 200/330; 200/331

(58) Field of Classification Search ..... 74/544; 200/330, 331; 403/65, 73, 119; 446/323; D8/300, 321, 322; D13/158, 168, 173, 174; D26/59, 72, 59.72
See application file for complete search history.

(56) References Cited

U.S. PATENT DOCUMENTS 2,668,456 A 2/1954 Meistrell
2,726,303 A * 12/1955 Berndsen ..... 200/331
3,142,744 A * 7/1964 Keck ..... 200/331
3,175,420 A 3/1965 Craig
3,722,319 A * 3/1973 Reznik et al. ..... 74/544
3,825,710 A 7/1974 Roberts et al.
3,839,615 A 10/1974 Bradford
4,256,943 A * 3/1981 Whitlock ..... 200/331
4,291,212 A * 9/1981 Bui ..... 200/331
4,419,556 A 12/1983 Hare
4,562,325 A 12/1985 DeRouen
4,567,337 A * 1/1986 Woods et al. ..... 200/331
4,590,345 A 5/1986 Marshell
4,745,243 A 5/1988 Wang
5,017,746 A 5/1991 Guimarin
5,046,143 A 9/1991 Uher
5,055,645 A 10/1991 Hull et al.
5,782,342 A * 7/1998 Hewitt et al. ..... 200/331
6,403,903 B1 6/2002 Montano et al.
6,822,177 B1 * 11/2004 LaPlante ..... 200/331

* cited by examiner

*Primary Examiner*—Michael A. Friedhofer
(74) *Attorney, Agent, or Firm*—Shoemaker and Mattare

(57) ABSTRACT

A light switch extension includes a resilient socket member which can be pushed over the end of a wall switch handle, and an elongate extension member depending from the socket so that a child too short to reach the light can operate it without having to climb on furniture or the like. The extension member has at its upper end a ball which, with the socket, forms a universal joint so that the extension can be operated at non-vertical angles, and torque cannot be applied to the switch handle.

6 Claims, 3 Drawing Sheets

LIGHT SWITCH EXTENSION

This application claims priority from U.S. Provisional Patent Application No. 60/558,324, filed Mar. 31, 2004.

BACKGROUND OF THE INVENTION

This invention is light switch extension which enables people—particularly children—who cannot reach a wall switch to operate the switch safely from the floor, removing the temptation to scale furniture or the like to reach to the switch.

A number of prior inventions have provided devices of this general type. Some were too complex to be successful; some would permit a child to apply too much force or torque to the switch; and some could not tolerate substantial left-right deviations of the extension from a vertical orientation. U.S. Pat. No. 3,175,420 discloses a light switch extension comprising a rubber cap which is pushed over the handle of a wall switch, and an elongate member which is connected to the cap by a pin connection.

When one operates a wall switch directly with the fingers, it is not possible to apply substantial torque to the switch handle. However, when an extension member is attached to the handle, unless there is a torque and force limiting connection between the switch and the extension, damaging torques and force can be generated even by innocent movements of the extension. It is therefore important to provide a light switch extension intended for use by children with a connection to the light switch which prevents damage to the switch proper.

SUMMARY OF THE INVENTION

An object of the invention is to improve the operation of a light switch extension handle.

Another object is to provide a light switch extension which has a disassembly force less than the force which would damage a switch.

A related object is to enable a manufacturer to adjust the torque and force limits of the device by making very minor design changes.

These and other objects are attained by a light switch extension handle as described below.

BRIEF DESCRIPTION OF THE DRAWINGS

In the accompanying drawings.

DESCRIPTION OF THE PREFERRED EMBODIMENT

Figure 1:
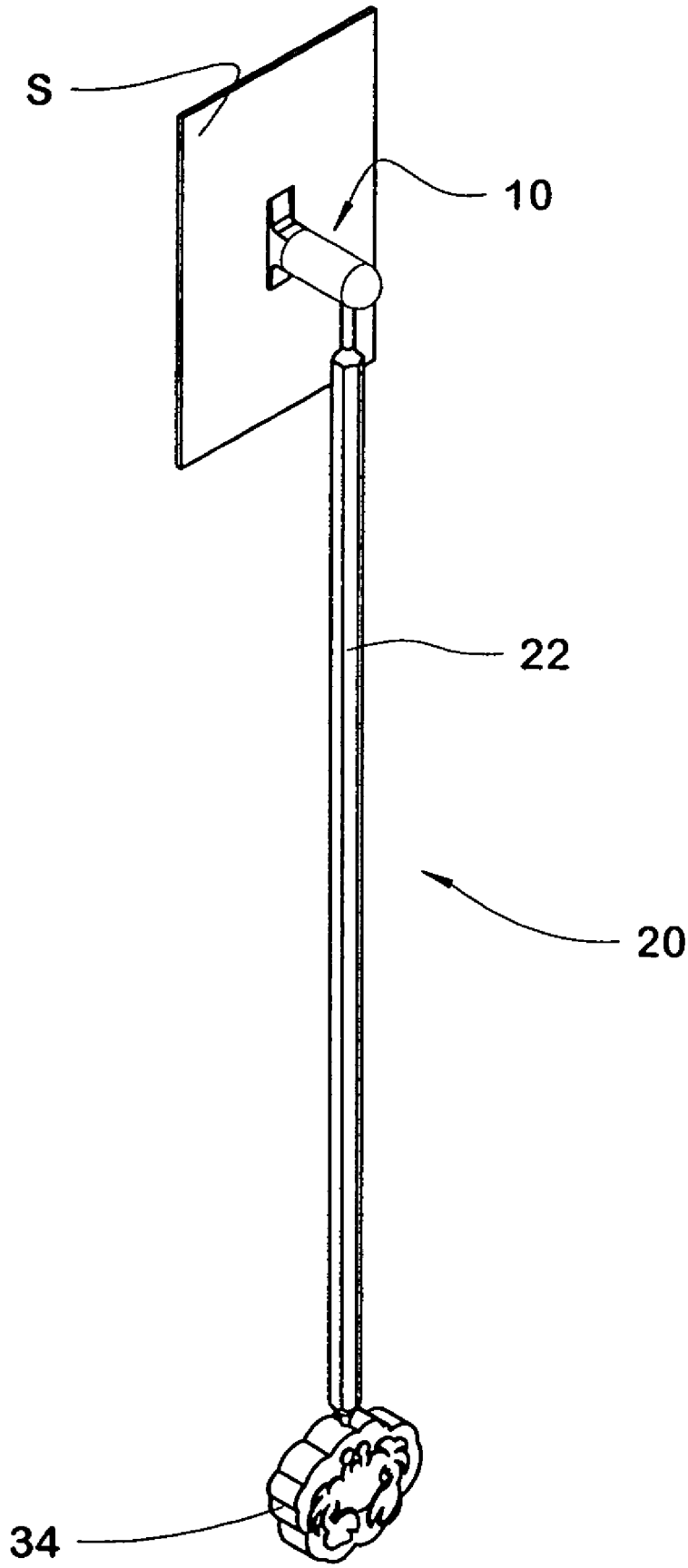
FIG. 1 is an isometric view of a light switch extension embodying the invention.
Figure 2:
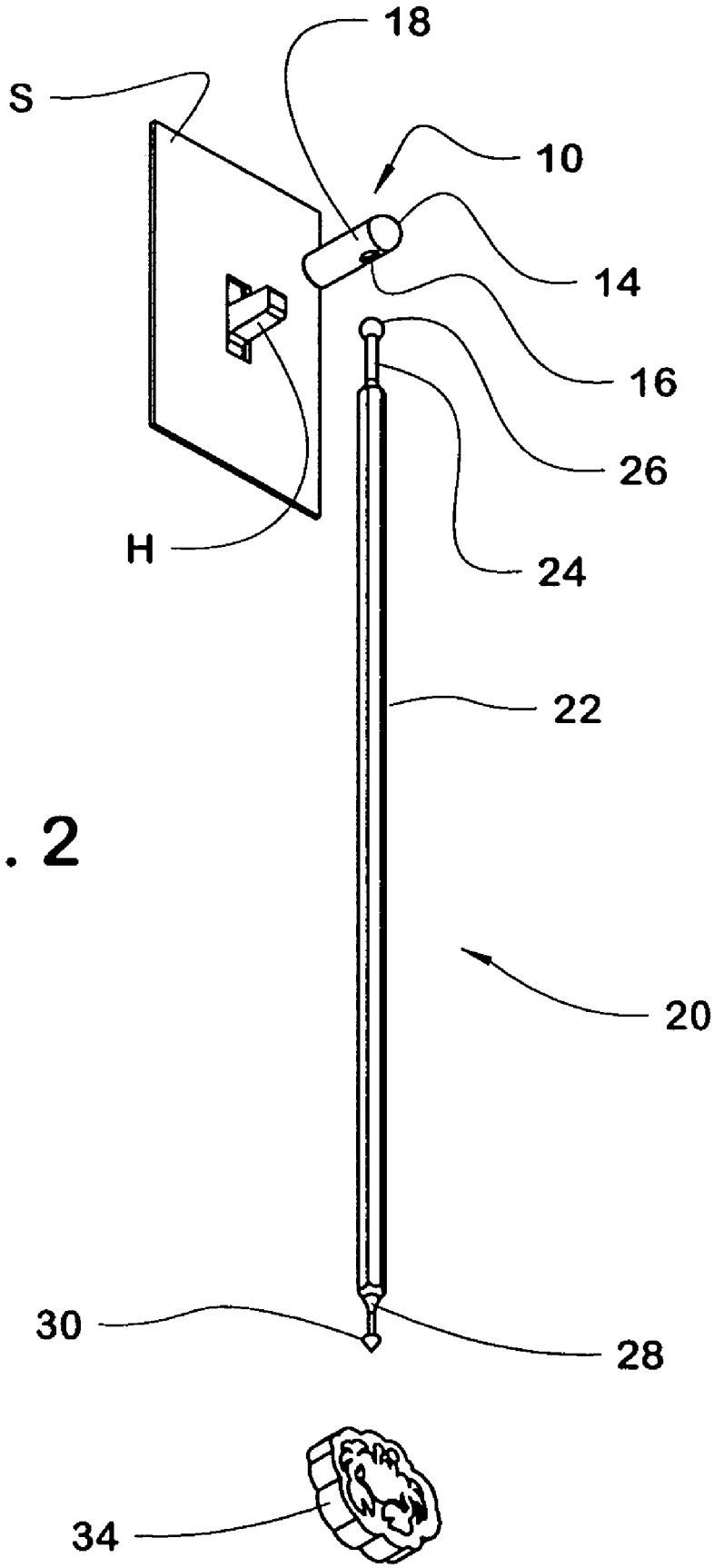
FIG. 2 is an exploded isometric view thereof.
Figure 3:
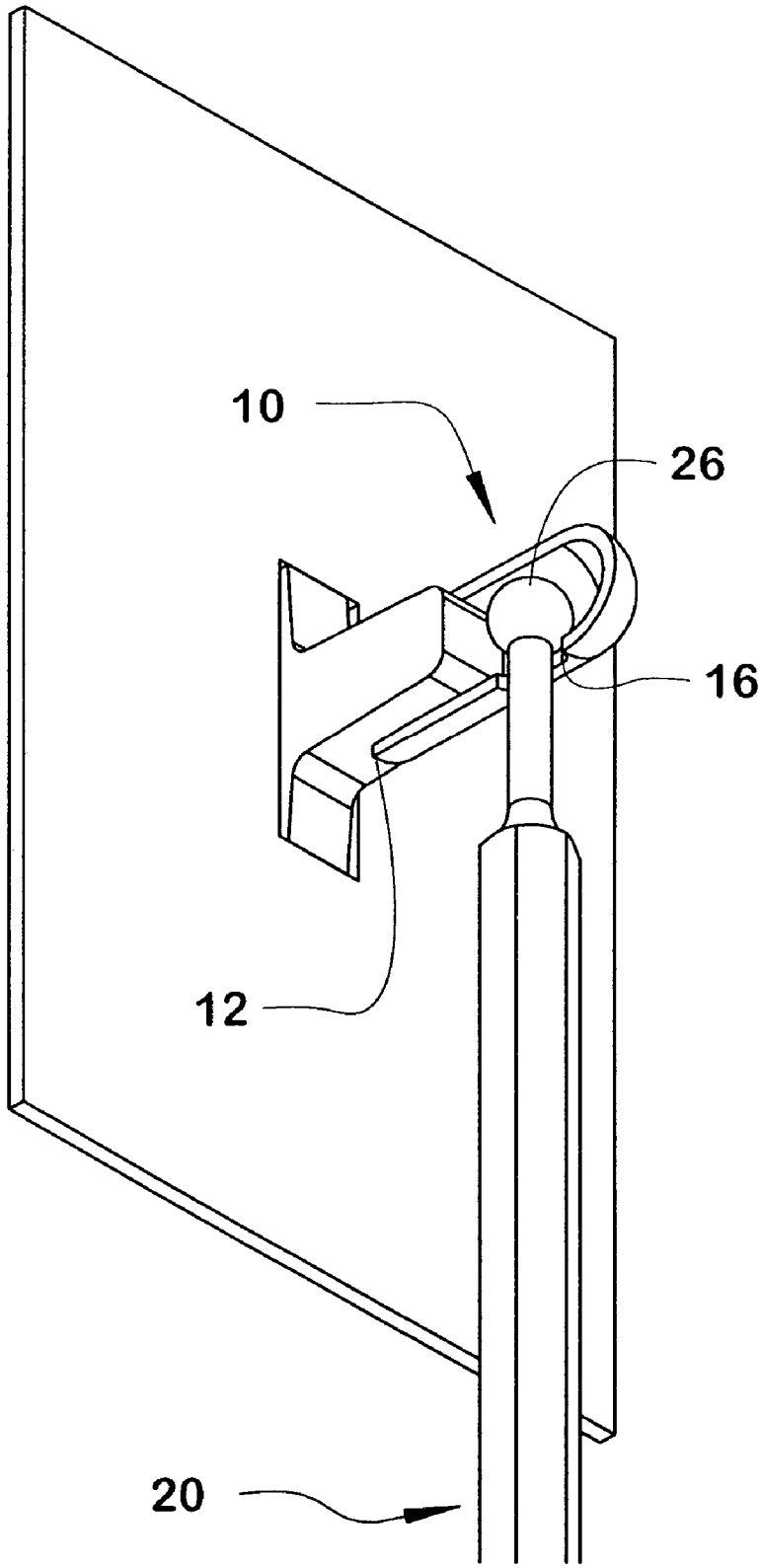
FIG. 3 is an enlarged sectional view of the device, taken on the plane 3—3 in FIG. 1.

As shown in FIG. 2, a light switch extension embodying the invention comprises a socket 10 which can be pushed over the handle "H" of a conventional wall switch "S". The socket, which has an open end 12 and a rounded closed end 14, is preferably made of a polymeric material such as a vinyl. The socket is soft enough that, as it is pushed onto the switch handle, the open end can deform to the shape of the handle "H" and expand resiliently so as to grip the handle securely. I presently prefer that the socket have an outer diameter of about 0.38 inch, an inner diameter of about 0.281 inch, and a length of about one inch. With these dimensions, the wall thickness is about 0.05 inch.

There is a small oval hole 16 in the wall 18 of the socket, near the rounded end. I presently prefer that the hole have a maximum width of about 0.125 inch and an overall length of about 0.25 inch, and that its center be about 0.683 inch from the open end 12.

An elongate extension member 20, having a length of a foot or more, is made of a substantially rigid material, preferably a hard plastic such as a transparent acrylic. The extension member has a central portion 22, which is shown as hexagonal in the drawing but could be of any cross-section. At its upper end, the central portion tapers to a neck 24 at the end of which is a ball 26. The ball is larger in diameter (preferably about 0.24 inch) than the width of the socket's hole 16. It is pushed through the hole during assembly and the interference fit is sufficient to keep the parts united in normal use.

The lower end of the member 20 tapers to a neck 28 which terminates at a barb 30. The barb can be pushed into a hole (not shown) formed in an ornamental pull member 34. The shoulder 36 at the upper end of the barb keeps the part together.

The ornamental pull member 34 is designed to be attractive to children, and is sized to fit a child's hand.

The device is installed on a wall switch simply by pushing the socket 10 onto the handle "H". No tools are required. Now a child too short to reach the switch can work it simply by grasping the attractive pull at pushing up or down. The universal joint provided by the ball and socket permits the extension to be moved substantially away from its vertical rest orientation, so the child need not have fine motor skills.

To protect the switch from exuberant pulling and twisting, the parts are sized so as to come apart when a threshold force is applied. Yanking down—or sideways—on the pull or the handle causes the assembly to come apart (the ball 26 pulls out of the hole 16) long before damaging force levels are reached. The device also tolerates any amount of twisting (turning around the axis of the member 20) by the child. Because the ball can turn easily within the socket, no torque can be delivered to the switch.

One can achieve the desired disassembly force levels with routine experimentation by altering the ball diameter, the socket hole width, the wall thickness of the socket and/or the stiffness of the socket material.

Since the invention is subject to modifications and variations, it is intended that the foregoing description and the accompanying drawings shall be interpreted as only illustrative of the invention defined by the following claims.

I claim:

1. A light switch extension assembly comprising a socket sized to be pushed onto a handle of a conventional wall switch, and an elongate extension member having an upper end and a lower end and a ball at said upper end, the ball being retained in the socket in such a way as to provide a universal connection between the socket and the extension member, whereby the extension member enables one to operate said handle by grasping a lower end of the extension member while preventing damaging torque from being applied to said handle, wherein the ball has a pull-out force from the socket which is less than a predetermined threshold force which could damage the switch.

2. The light switch extension assembly of claim 1, wherein the socket is formed of a resilient material and has a wall of a predetermined wall thickness, and a hole having a predetermined maximum width extending through the socket wall, wherein said width is less than the diameter of the ball so as to resist disassembly of the socket and the elongate member.

3. The invention light switch extension assembly of claim 2, wherein the socket's material, the wall thickness, the hole width and the ball diameter are selected to provide a disassembly force sufficiently low to prevent one from damaging the switch by yanking on the elongate member.

4. The light switch extension assembly of claim 1, further comprising a pull member connected to the lower end of the elongate member, wherein the pull member is made of a foam material.

5. The light switch extension assembly of claim 4, wherein the pull member has a decorative feature.

6. The light switch extension assembly of claim 4, wherein the extension member is inserted into a hole in the pull member and has a barb at said lower end to retain the pull member thereon.

* * * * *